United States Patent [19]

Eckold et al.

[11] Patent Number: 4,928,370

[45] Date of Patent: May 29, 1990

[54] TOOL SET FOR CONNECTING SUPERPOSED SHEET METAL WORK PIECES

[76] Inventors: Gerd-Jurgen Eckold, Silberhutte 11, 3424 St. Andreasberg; Hans Maass, Germelmannstra. 12, 3422 Bad Lauterberg, both of Fed. Rep. of Germany

[21] Appl. No.: 324,825

[22] Filed: Mar. 17, 1989

[30] Foreign Application Priority Data

Mar. 19, 1988 [DE] Fed. Rep. of Germany ..... 8803773

[51] Int. Cl.[5] ..... B23P 19/00

[52] U.S. Cl. ..... 29/243.5; 29/524.1; 29/21.1

[58] Field of Search ..... 29/243.5, 21.1, 509, 29/522.1, 283.5, 524.1

[56] References Cited

U.S. PATENT DOCUMENTS

| | | | |
|---|---|---|---|
| 2,627,766 | 2/1953 | Marchant | 29/522.1 |
| 3,579,809 | 5/1971 | Wolf | 29/522.1 |
| 3,599,318 | 8/1971 | Behlen | 29/21.1 |
| 4,208,776 | 6/1980 | Schleicher | 29/243.5 |
| 4,688,316 | 8/1987 | LaBarge et al. | 29/243.5 |
| 4,757,609 | 7/1988 | Sawdon | 29/509 |

FOREIGN PATENT DOCUMENTS

| | | | |
|---|---|---|---|
| 206465 | 12/1954 | Australia | 29/509 |
| 2069394 | 8/1981 | United Kingdom . | |

*Primary Examiner*—Daniel C. Crane

*Attorney, Agent, or Firm*—Cushman, Darby & Cushman

[57] ABSTRACT

A press-driven tool set for joining sheet metal work pieces comprises a die member and a punch member. The die member includes an anvil spaced by a deep gap from a forming member. Deformed material may flow into the gap without filling it so as to cope with thickness tolerances. Debris, such as oil and chips, may collect in the gap. The forming member may be comprised of segments which can be spread apart, facilitating removal of connected work pieces.

16 Claims, 1 Drawing Sheet

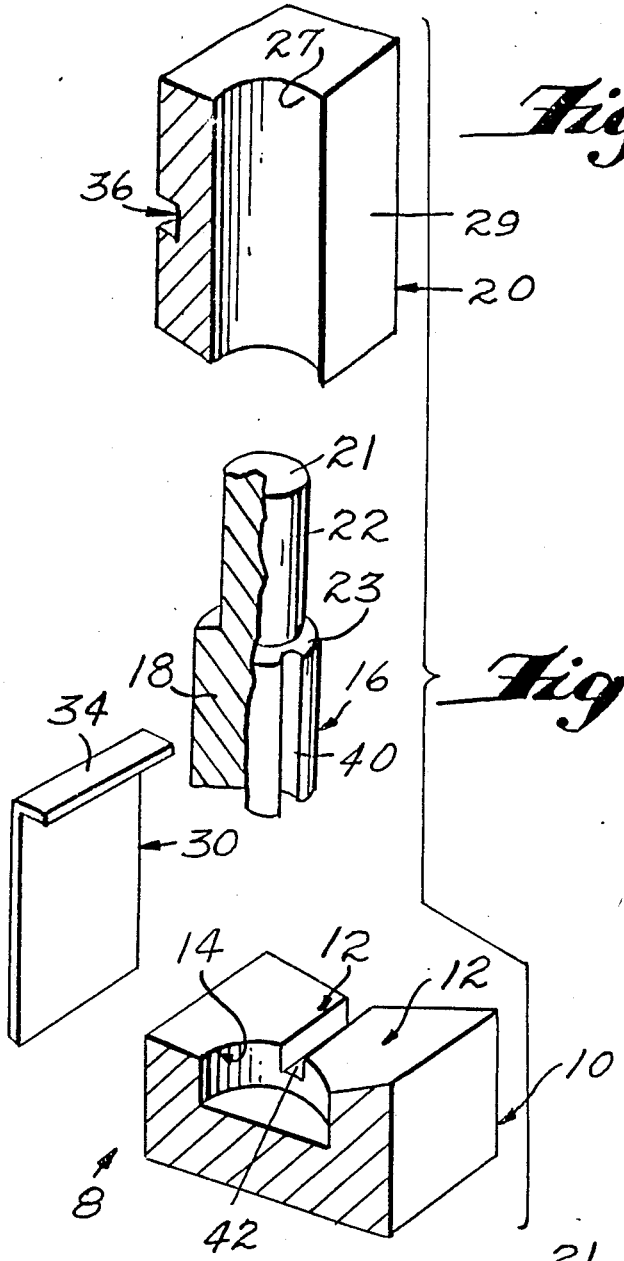
Fig. 2.
Fig. 1.
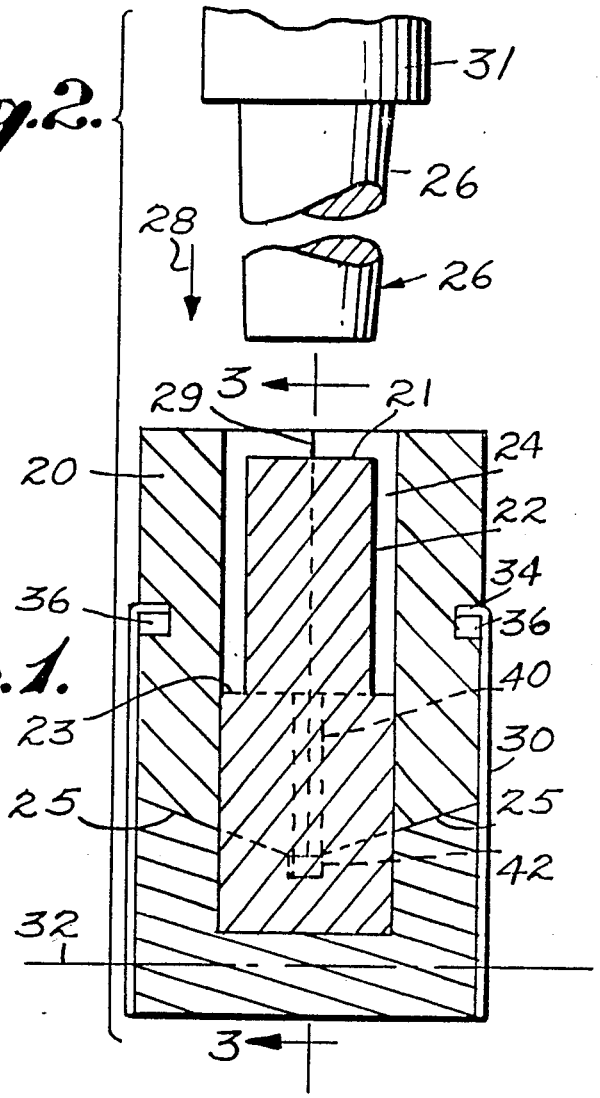
Fig. 3.
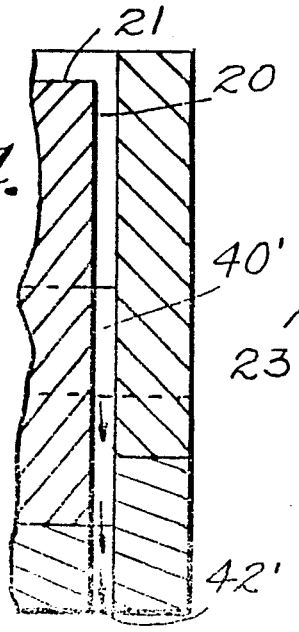
Fig. 4.
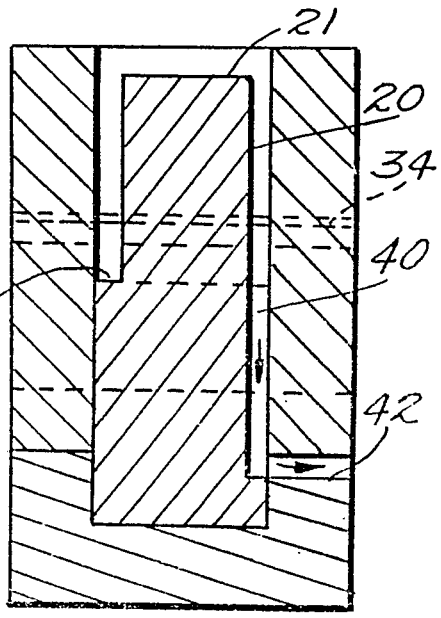
Fig. 5.
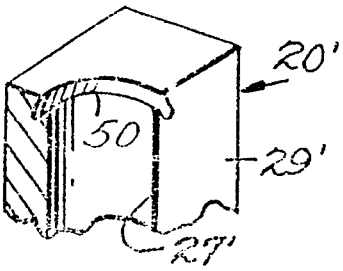

TOOL SET FOR CONNECTING SUPERPOSED SHEET METAL WORK PIECES

BACKGROUND OF THE PRESENT INVENTION

The present invention relates to a tool set adapted to be mounted in and to be driven by a press so as to join or connect a plurality of sheet metal work pieces. In U.S. Pat. No. 3,771,216 a tool set is disclosed that produces such a connection. In this reference, a punch deforms a portion of two overlapped metal sheets so that the deformed portions of the metal fill a die cavity without cutting through the sheets. Connections produced by such a tool have several advantages: they are fluid-tight, have an attractive shape and appearance, and are relatively strong.

The tool set disclosed in the referenced document provides that the deformed material will completely fill the cavity defined by the anvil, die, and punch. There is no means disclosed to remove debris from the bottom of the cavity while the punch is in the cavity. However, work pieces to be joined frequently are oily or greasy or have other incompressible impurities, such as dust, metal, chips, iron filings, coatings, varnish, etc on their surface. Consequently, when the pressing force applied thereon is predetermined, the connection may be insufficiently strong and may fail. If the press has a predetermined stroke length, the unavoidable irregular thickness tolerances of the pieces of sheet metal can result either in a joint of insufficient strength or, on the contrary, in the development of extremely high expansive forces to be absorbed by the die which, consequently, must be very rigid and is therefore relatively cumbersome.

SUMMARY OF THE PRESENT INVENTION

It is an object of the present invention to provide a tool set for safely connecting a plurality of superposed sheet metal work pieces even if the work pieces are oily or greasy.

It is a further object of the present invention to provide a tool set for safely and properly joining a plurality of superposed sheet metal work pieces in spite of thickness tolerances thereof.

It is yet a further object of the present invention to provide a tool set of relatively small dimensions for safely joining sheet metal work pieces.

According to the present invention, the tool set comprises a driven punch and an anvil, the punch being mounted on a reciprocative press opposite to the anvil. The anvil is surrounded by a forming member which protrudes axially beyond the working end face of the anvil so as to define a die cavity there around. The forming member, however, is spaced from the sides of the anvil by a gap which has a depth extending axially for a predetermined distance, greater than is necessary to effectively form the joint between the metal sheets so that even the thickest sheet metals to be worked cannot fill the gap completely. The depth of the gap may be as great as $\frac{1}{3}$–$\frac{1}{2}$ the length of the anvil. Any grease, oil or other impurities may collect within or at the lower portions of the gap, and preferably, a drain is provided in communication with a suitable discharge outlet so that the collected liquid or other debris may be removed.

In addition to the drawbacks mentioned above for the prior art tool sets, material which is deformed into the die cavity is frictionally held in the die so that considerable forces are required to remove the work pieces from the die. According to the present invention, it is preferred to have the forming member split into a plurality of segments which may be spread apart upon withdrawal of the deformed or joined work pieces. Such spreading segments are known per se from other types of joining tools, as disclosed, e.g., in U.S. Pat. No. 4,459,735. The segments of this type of tool, however, have already spread apart during deformation.

It is preferred to construct the die member using a number of individual parts, i.e. a socket, forming member segments, and an anvil. This allows for each part to be made from the material best suited for its particular purpose.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 1 is an exploded partial perspective view of a die according to the present invention with part of the die member being partly illustrated in section;

FIG. 2 is a section view of the die member and a partial side elevation of the punch;

FIG. 3 is a cross-sectional view of the die member taken along line 3—3 of FIG. 2 showing the drain and discharge chute.

FIG. 4 is a cross-sectional view of the die member illustrating an alternative design of a drain and discharge chute; and FIG. 5 is a perspective view illustrating an alternative design of a die segment.

DETAILED DESCRIPTION OF THE INVENTION

Referring to FIGS. 1 and 2, the die member 8 comprises a socket 10 which can have any shape, such as, for example, the rectangular shape shown in FIG. 1. The die will also have a top side surface 12 preferably defined by a flattened or opened V-shaped profile. Socket 10 is also provided with a central bore 14 which has a diameter suitable to accommodate a foot portion 18 of an anvil 16. Anvil 16 has a stepped upper cylindrical shape 22 extending from end 21 downwardly along a portion of its height terminating at a shoulder 23. While anvil 16 is shown as having a circular cross-section other shapes of the anvil (and of adapted forming members) are readily conceivable, such as oval, square, diamond or other shapes perhaps with intended portions. In FIG. 1, anvil 16 is rotated 45° to show drain 40, the lower end of which abuts the inner end of discharge 42, which is shown in further detail in FIGS. 2 and 3.

Two forming member segments 20 having oblique bottoms 25 complementary to the V-shape of socket 10 are mounted on socket 10 so that the segments may be supported by surfaces 12. More than two forming member segments may, alternatively, be used, for example, 3, 4 or 6 segments with each separate segment having its own separate refraining member such as leaf spring 34 or other elastic means. The segments are preferably mounted so that they are pivotally movable relative to surfaces 12 and the V-shaped profile. The segments 20 further have half-cylindrical recesses 27 milled or otherwise formed therein complementary to the foot portion 18 of anvil 16. This shape allows the segments 20 to be positively positioned relative to the anvil. These recesses 27 also define, together with the working portion 22 of anvil 16, an annular gap 24. Segments 20 also include mutually mating surfaces 29 which abut when positioned about anvil 16.

The die is adapted to be mounted on a conventional press table (not shown) and cooperates with a punch 26 which is to be mounted on the press ram 31 in alignment with anvil 16 so as to be driven in a conventional manner and in the direction of arrow 28.

With two or more sheet metal work pieces disposed between the die member 8 and the punch 26, actuation of the press deforms the material between the punch and anvil forcing material into the die cavity without cutting the sheet metal pieces. Some of the material will flow into gap 24 so that the two layers of sheet metal are crimped or interengaged about one another at that point. The segments 20 are pressed by the work pieces against socket 10, which has a V-angle that is dimensioned such that the segments cannot laterally yield. Upon withdrawal of the punch, the work pieces adhere thereon because the segments are lifted from the socket and may now laterally give way. Leaf springs 30 are removably connected to socket 10 by any convenient means such as screws or bolts (not shown) at a position indicated by dash-dotted line 32. The free ends 34 of the leaf springs 30 are angled and engage or extend into, with some clearance, respective notches 36 of segments 20. Leaf springs 30 restore the initial position of the forming member segments 20 once a workpiece has been removed from the die member 8. Instead of leaf springs, other elastic means may be provided, such as rubber rings and the like. However, all that is required is that the segments 20 be yieldably secured on socket 10.

In FIG. 3, drain 40 connects with shoulders 23 and leads downwardly, away therefrom so as to open into a chute or discharge 42 of socket 10, that in turn leads to a sump or other collection area (not pictured). FIG. 4 shows another embodiment, with drain 40' which leads to discharge 42'.

A modified form of the segment is illustrated in FIG. 5. Segment 20' has an undercut edge 50 positioned so as to extend about the periphery of the half-cylindrical recess 27'. The undercut 50 extends in the direction of its yielding movement and may be filled, at least partially, by deformed sheet material so as to increase the strength of the joint.

While the invention has been described in connection with what is presently considered to be the most practical and preferred embodiment, it is to be understood that the invention is not to be limited to the disclosed embodiment, but on the contrary, is intended to cover various modifications are equivalent arrangements included within the spirit and scope of the appended claims.

We claim:

1. A tool set to be mounted in and to be driven by a press for connecting a plurality of superposed sheet metal work pieces of predetermined thickness by forming a joint therebetween, said tool set comprising:

a punch member having a substantially flat end face, and a die comprising an anvil having a substantially flat end face mounted opposite said punch end face and a forming member surrounding said anvil, thereby defining the sides and a bottom of a die cavity, said forming member being spaced a predetermined distance from at least a portion of said anvil so as to define a gap therebetween which opens toward said anvil face so that upon press actuation metal material can be deformed into said die cavity and said gap, said gap being present when said die is not in use and said gap encompassing the entire circumference of said anvil, said gap being dimensioned so that it is deeper than necessary to form the joint and so said metal material cannot fill said gap, said die including means for supporting said forming member in a stationary manner relative to said anvil during said deformation.

2. The tool set of claim 1 wherein said metal work pieces are not cut by said punch member.

3. The tool set of claim 1 wherein said tool set further includes drain means for removing debris from said gap.

4. The tool set of claim 3 wherein said drain means comprises an opening exposed within said gap, means defining a discharge outlet, and an interconnecting passageway.

5. The tool set of claim 1 wherein said forming member comprises a plurality of segments having a first end and a second end, said segments being adapted to allow at least said first ends to be spread apart for removal of said work pieces.

6. The tool set of claim 5 wherein said die further comprises a socket, said anvil being inserted into said socket, and said segments being supported by said socket.

7. The tool set of claim 6 wherein said socket and said segments have interengaging support faces, said segment support faces being movably supported at said second end of said segments.

8. The tool set of claim 7 wherein said anvil protrudes beyond said socket support faces and said segments abut said anvil at a point lower than said gap.

9. The tool set of claim 5 wherein a resetting spring is operatively connected to each segment.

10. The tool set of claim 6 wherein a resetting spring is operatively connected to each segment.

11. The tool set of claim 7 wherein a resetting spring is operatively connected to each segment.

12. The tool set of claim 8 wherein a resetting spring is operatively connected to each segment.

13. The tool set of claim 5 wherein said segments are undercut at said first end.

14. The tool set of claim 6 wherein said socket, said anvil and said segments are made from different materials.

15. The tool set of claim 7 wherein said segment support faces are angled such that the interengaging faces of said segments cannot laterally yield when said punch enters said cavity.

16. The tool set of claim 15 wherein said segment support faces are angled such that the segments can laterally yield when said punch exits said cavity.

* * * * *